United States Patent [19]

Goldner

[11] Patent Number: 4,553,467

[45] Date of Patent: Nov. 19, 1985

[54] PAGE TURNING APPARATUS AND METHOD

[76] Inventor: Richard Goldner, 3717 Toad Lake Rd., Bellingham, Wash. 98226

[21] Appl. No.: 544,694

[22] Filed: Oct. 24, 1983

[51] Int. Cl.[4] ..... G10G 7/00

[52] U.S. Cl. ..... 84/487; 84/505; 84/506

[58] Field of Search ..... 84/486–521

[56] References Cited

U.S. PATENT DOCUMENTS

| | | | |
|---|---|---|---|
| 896,480 | 8/1908 | Swanson | 84/487 |
| 940,219 | 11/1909 | Van Aine | 84/487 |
| 1,059,901 | 4/1913 | Neiman | 84/487 |
| 1,215,262 | 2/1917 | Faist | 84/486 |
| 1,339,261 | 5/1920 | Jolley | 84/487 |
| 1,397,885 | 11/1921 | Stevens | 84/487 |
| 1,595,220 | 8/1926 | Baer | 84/502 X |
| 1,735,166 | 11/1929 | Hossell et al. | 84/486 |
| 1,849,459 | 3/1932 | Klaussen | 84/486 |
| 2,991,680 | 7/1961 | Elliott | 84/517 |

*Primary Examiner*—Benjamin R. Fuller

*Attorney, Agent, or Firm*—Reed Smith Shaw & McClay

[57] ABSTRACT

A page turning device is provided in which a first elongated arm is rotatably mounted for circular motion substantially parallel to but above the plane of the volume. A page lifting facility cooperates with the rotation of the first elongated arm to permit the first elongated arm to rotate between a lifted upper leaf and the remainder of the leaves of the volume. Continued rotation of the first elongated arm turns the upper leaf and positions the arm for turning of the next leaf. In this manner an unlimited number of leaves may be sequentially turned by a mechanically simple device which is immediately ready for use when a volume is positioned thereon.

13 Claims, 4 Drawing Figures

PAGE TURNING APPARATUS AND METHOD

FIELD OF THE INVENTION

The present invention relates generally to devices for turning the pages of books and leaves of a volume of music.

DISCUSSION OF THE TECHNICAL PROBLEM

It is well recognized in the art that a device is needed which can be used by a musician to turn leaves of music while the musician's hands are occupied. Examples of such devices can be found in U.S. Pat. Nos. 896,480; 940,219; 1,059,901; 1,251,169; 1,215,262; 1,339,261; 1,397,885; 1,595,220; 1,735,166 and 1,849,459. However, these devices are seriously limited in their usefulness because they generally utilize a plurality of elongated arms which must be manually positioned between the leaves to be turned. Not only is such a device inconvenient to use, but it is also inherently limited in the number of leaves which it can turn before it must be reset, and is unsatisfactorily complex. It would be desirable to have a mechanically simple page turning apparatus which can turn an unlimited number of leaves in sequence and requires no preliminary set-up.

SUMMARY OF THE INVENTION

The present invention provides a method of and an apparatus for turning pages of an open volume, including a facility for lifting a top leaf near its free end from a stack of leaves an initial distance, a first elongated arm member movable in cyclical arcuate motion in a plane substantially parallel to the plane of the stack of leaves, and means for actuating the cyclical arcuate motion of the first elongated arm member.

The first elongated arm is conveniently introduced between the upraised top leaf and the open volume and continues its arcuate motion to turn the top leaf from one side of the open volume to the other. In this manner, an unlimited number of leaves may be sequentially turned and no preliminary set-up work is required except to open the volume to the desired starting point and position it relative to the page turning device. The movement of the elongated arm is conveniently controllable by electrical and/or electronic facilities at positions remote from the open volume, e.g., by a musician's foot or knee, and mechanical simplicity is provided.

DESCRIPTION OF THE PREFERRED EMBODIMENTS

Figure 1:
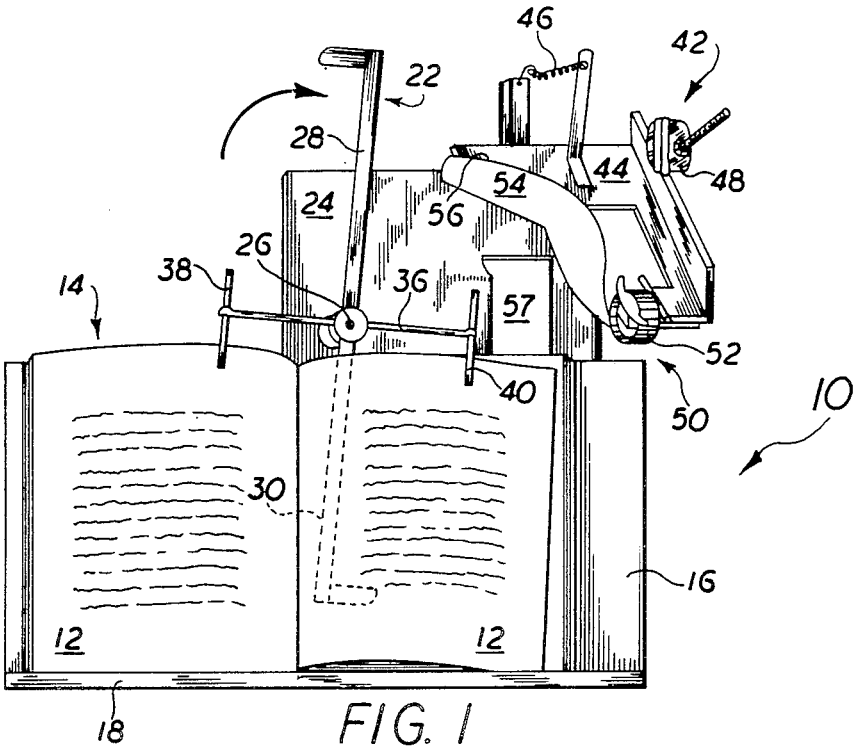
FIG. 1 is a perspective view of the front portion of a page turning device incorporating features of the present invention, in a position at the beginning of the page turning cycle thereof.

With reference to FIGS. 1–4, there is shown a page turning device 10 for turning the leaves 12 of an open volume 14. Although not limiting to the invention, page turning device 10 may include means for supporting the volume, e.g., a support face 16 and a support ledge 18 upon which the volume 14 may be conveniently rested. A hingably secured support bracket 20 may be conveniently positioned on the rear of support face 16 to hold the support face 16 in any desired inclination from the vertical. (see FIG. 4) Alternatively, the invention may be practiced utilizing a conventional music stand or piano stand to support the music or volume.

With continued reference to FIGS. 1–4, a first elongated arm member 22 is mounted to plate 24 on shaft 26 adjacent to the center region of the support face 16 to rotate through a circular path which is substantially parallel to but above the plane of the volume 14 on support face 16. As shown in the Figures, arm member 22 may conveniently include elongated portions 28 and 30 extending outwardly on opposite sides of shaft 26, with elongated portions 28 and 30 including slidably adjustable transverse fingers 32 and 34, respectively, at suitable locations therealong. In a manner which will be more apparent from later discussion, elongated portions 28 and 30 serve to alternately turn leaves of volumes 14.

Although not limiting to the invention, device 10 may also include a second elongated arm 36 mounted to shaft 26 spaced above and extending in a direction transverse to first elongated arm 22. Second elongated arm 36 is shorter in length than first elongated arm 22 and includes a pair of exposed hold-down members 38 and 40 at distal ends thereof, to hold the top leaf of volume 14 in a viewable position until turning is effected. First and second elongated arms 22 and 36 are each vertically adjustable in position on shaft 26 to accomodate volumes of different thickness.

Page turning device 10 further includes a lifting facility 42 which functions to lift individual leaves of volume 14 near their free end to a predetermined elevated position above the plane of volume 14, and above the position of the elongated portions 28 and 30 as they sweep through that portion of their circular path which is above volume 14. Lifting facility 42 may include a pivotable bracket arm 44 hingably mounted to plate 24 and preferably extending over the end portions of the leaves of volume 14 when lowered thereto. A spring 46 secured between bracket arm 44 and plate 24 and a stop member 48 maintains bracket arm 42 in a rest position spaced from volume 14.

A leaf-securing element 50 is mounted at the end of bracket arm 44 to engage, lightly secure and lift sequential leaves of volume 14 when the bracket arm 44 is urged downwardly theretoward. Leaf-securing element 50 may take a wide variety of forms, including a magnetic member or a vacuum-actuated member. However, in a preferred embodiment of the invention, leaf-securing element 50 takes the form of an endless, rotatably mounted belt 52 having a selected adhesive material thereon which lightly adheres to all known paper materials and releases therefrom under appropriate urging without leaving a residue. Preferably a resilient cushion is positioned inside endless belt 52 to facilitate proper pressure contact between endless belt 52 and leaves of volume 14.

Figure 3:
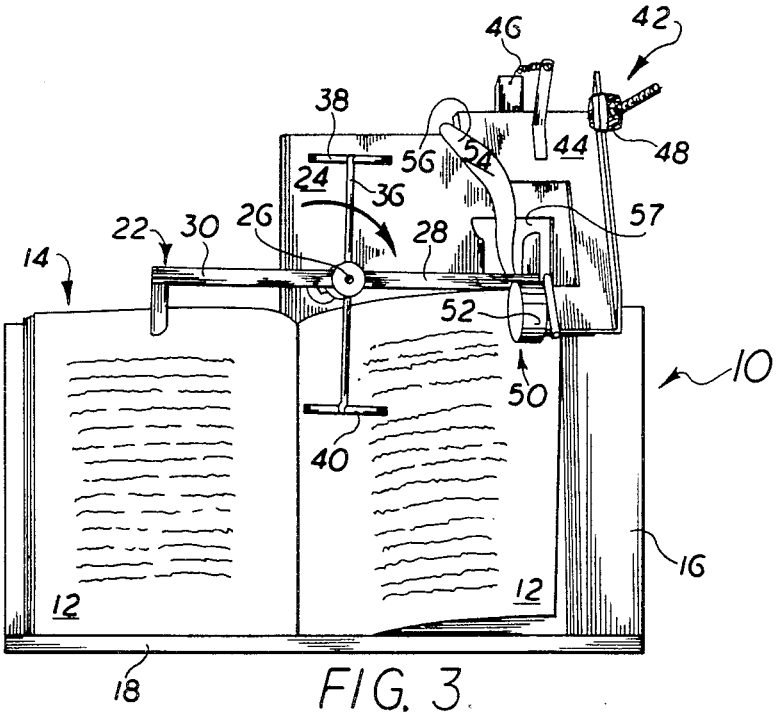
FIG. 3 is a view similar to the view of FIG. 1, showing the page turning device in a position near the end of the page turning cycle.

In the embodiment of the invention shown in FIGS. 1–4, a cam member 54 is secured to pivotable bracket arm 44 and controls the movement thereof by its interaction with elongated portions 28 and 30. More particularly and with reference to FIG. 2, an elongated portion 28 or 30 travels through its circular path in a clockwise direction, elongated portion 28 or 30 engages the cam surface 56 of cam member 54 and forces bracket arm 44 (and leaf-securing element 50) toward the volume 14 against the biasing force of spring 46. Leaf-securing element 50 engages and lightly secures the top leaf of volume 14 as elongated portion 28 or 30 moves up cam surface 56. In this orientation, a portion of cam member 54 extends through a window 57 in the plate 24. As elongated portion 28 or 30 passes the apex of cam surface 56, the spring 46 urges the bracket arm 44 away from volume 14 and leaf-securing element 50 lifts the top leaf of volume 14 to an elevation determined by stop member 48. As elongated arm 22 continues its arcuate movement, elongated portion 28 or 30 travels between the elevated top leaf and the underlying leaves of volume 14. As the arcuate motion continues, elongated portion 28 or 30 engages the underside of the top leaf and exerts sufficient force thereto to overcome the light hold of leaf-securing member 50. As elongated portion 28 or 30 approaches the centerline of volume 14, one of hold-down members 38 and 40 moves into position over the top leaf to maintain same in a conveniently observable position. Continued arcuate motion turns the top leaf about the centerline of volume 14 and uncovers a fresh leaf for viewing by the user. As shown in FIG. 3, transverse fingers 32 and 34 serve to hold previously turned pages in an open position and thereby avoid the tendency of recently turned pages to flip back of their own accord or under windy or drafty conditions.

As can be now appreciated, the rotary motion of arm member actuates and controls the movement of the lifting facility 42. The rotary motion of arm member 22 may be conveniently energized by an electrical motor 60 which may be attached to the rear of plate 24 to drive shaft 26. The operation of motor 60 may conveniently controlled from a remote control device 62, e.g., a push button or switch, positioned conveniently for the user, e.g., for foot actuation by a musician. Preferably, motor 60 is selected to provide arm member 22 with a controlled sweep of arcuate motion upon each actuation, to occur at a controlled, relatively slow rate. For example, motor 60 can be selected to provide 180° of arcuate motion for arm member 22 such that either elongated portion 28 or 30 can complete one leaf-turning cycle before coming to rest to await the next actuation of motor 60. With reference to FIG. 1, it is preferable to control motor 60 to start and stop arm member 22 at a predetermined starting position, in which one of elongated portions 28 or 30 is positioned under the top leaf to be turned, adjacent the centerline of volume 14. In this starting position, elongated portion 28 or 30 is in position to immediately turn the top leaf upon actuation of motor 60, while hold-down member 38 or 40 holds the free end of the top leaf down loosely for convenient viewing.

Figure 2:
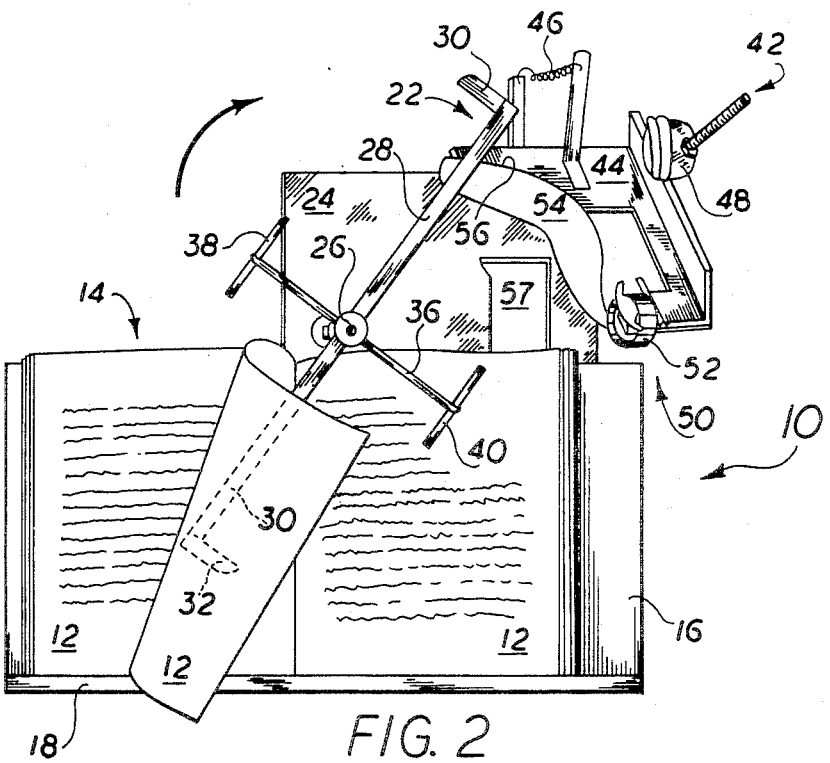
FIG. 2 is a view similar to the view of FIG. 1, showing the page turning device in an intermediate position in the page turning cycle.
Figure 4:
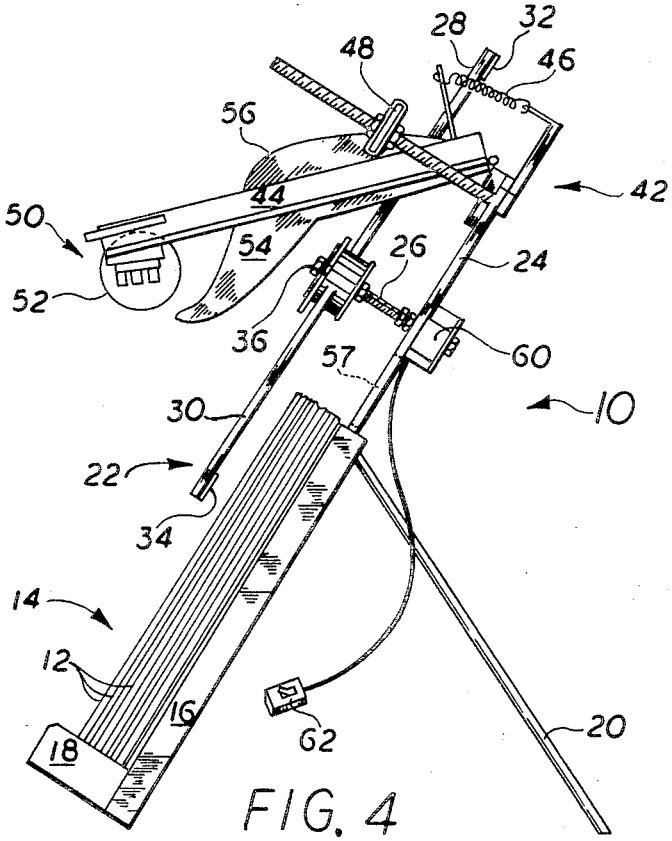
FIG. 4 is an elevated side view of the page turning device shown in FIG. 1.

As shown in FIG. 2, upon actuation of motor 60, elongated portion 28 or 30 rotates to flip the top leaf while the opposing elongated portion begins to move along cam surface 56 of cam member 54 to actuate lifting facility 42. As shown in FIG. 3, continued rotation of elongated portion 28 or 30 along cam surface 56 lowers and then raises leaf-securing element 50 with the newly-uncovered top sheet and the elongated portion moves thereunder. As shown in FIG. 1, motor 60 is de-actuated when elongated portion 28 or 30 has continued to near the centerline of the volume 14, and hold-down member 38 or 40 has moved into position to loosely retain the top leaf for convenient viewing. Thus, 180° of rotation of shaft 26 results in one complete cycle of page turning, with actual turning of the top leaf occuring at the beginning of the cycle so that a musician need not actuate motor 60 prior to playing to the end of the music on a sheet.

Of course, the present invention is not intended to be limited to the specific embodiments of the invention described above. For example, cam member 54 may be conveniently replaced by electrical timing and solenoid elements, whereby actuation of the remote control device 62 will activate motion of motor 60 and at the appropriate time, also activate an electrical solenoid which will lower and then raise the bracket arm 44 to lift the top leaf of volume 14. In like manner, electrical timing elements may be conveniently incorporated into the operation of the present invention to activate a vacuum-actuated leaf-securing member 50 which can draw a top leaf upward from the volume 14 without requiring movement of a bracket arm 44.

It is also to be understood that the present invention, while of great advantage and usefulness to musicians, is not intended to be limited to such use, for comparable advantage will be realized by disabled individuals. Accordingly, the scope of the present invention is limited only by the claims which follow.

What is claimed is:

1. An apparatus for turning the leaves of an open volume having a centerline about which leaves may be turned, comprising:

(a) a first elongated arm member, said first arm member mounted relative to said open volume for rotation in a plane generally parallel to the plane of said open volume, said path of rotation of said first arm member including a path portion which is a first distance over said open volume;

(b) means for lifting at least a portion of a top leaf a second distance above the underlying leaves of said open volume, said second distance being greater than said first distance;

(c) means for rotating said first elongated arm member through said path portion in a direction from the side of said volume centerline in which said top leaf is positioned toward the opposite side of said volume centerline, whereby said first arm member while rotating through said path portion becomes interposed between said top leaf and the underlying leaves of said open volume to turn said top leaf about said volume centerline; and (d) means for actuating said top leaf lifting means in synchronization with the rotation of said first arm member, such that at least a portion of said top leaf is lifted said second distance upon the arrival of said first arm member above that side of the volume centerline on which said top leaf is positioned to permit said first arm member to be interposed therebetween, further wherein said first arm member includes oppositely extending arm portions relative to the point of rotation of said first arm member, said arm portions alternatively turning the top leaf of said open volume.

2. The apparatus as set forth in claim 1, wherein said top leaf lifting means comprises:

bracket means movably mounted relative to said open volume for reciprocal motion to and away from a top leaf thereof; and means mounted to said bracket means for lightly securing said top leaf when said bracket means is adjacent said top leaf.

3. The apparatus as set forth in claim 2, wherein said means for lightly securing comprises:

adhesive belt means, said adhesive belt means rotatably mounted on said bracket means to present a varying adhesive surface toward said top leaf on sequential operations of said apparatus.

4. The apparatus as set forth in claim 3, wherein said actuating means comprises:

a cam member mounted to said bracket means for engagement with said first arm member as said first arm member rotates toward said path portion.

5. The apparatus as set forth in claim 3, wherein said actuating means comprises:

electrical solenoid means for controlling the reciprocal motion of said bracket means; and electrical timing means for energizing said electrical solenoid means in time with the movement of said first arm member.

6. The apparatus as set forth in claim 5, further comprising means for controlling said first arm member rotating means.

7. The apparatus as set forth in claim 6, wherein said controlling means is operable at a remote distance from said first arm member.

8. The apparatus as set forth in claim 7, wherein said controlling means starts and thereafter stops the rotation of said first arm member after a defined arcuate angle of movement has been traversed by said first arm member.

9. The apparatus as set forth in claim 8, further comprising:

stand means mounted relative to said first arm member for supporting said open volume thereon.

10. The apparatus as set forth in claim 9, further comprising:

means for adjusting the positions of said first arm member and said lifting means relative to said stand means to adapt said apparatus to volumes of different size.

11. The apparatus as set forth in claim 10, wherein said bracket means is mounted for pivotal reciprocal motion relative to said top leaf.

12. The apparatus as set forth in claim 10, wherein said bracket means is mounted for sliding reciprocal motion relative to said top leaf.

13. The apparatus as set forth in claim 10, further comprising:

a second arm member mounted above and transverse to said first arm member, said second arm member shorter in length than said first arm member and including hold-down members on end portions thereof.

* * * * *